US010285483B1

(12) United States Patent
Salvesen

(10) Patent No.: US 10,285,483 B1
(45) Date of Patent: May 14, 2019

(54) DELIVERING FOIL LEAVES OF SELECTED LENGTHS FROM AN INDETERMINATE LENGTH OF FOIL

(71) Applicant: Peter W. Salvesen, Mifflinburg, PA (US)

(72) Inventor: Peter W. Salvesen, Mifflinburg, PA (US)

( * ) Notice: Subject to any disclaimer, the term of this patent is extended or adjusted under 35 U.S.C. 154(b) by 650 days.

(21) Appl. No.: 14/942,303

(22) Filed: Nov. 16, 2015

(51) Int. Cl.
*A45D 19/00* (2006.01)
*B65H 35/00* (2006.01)
*B26D 5/38* (2006.01)

(52) U.S. Cl.
CPC ..... *A45D 19/0025* (2013.01); *B26D 5/38* (2013.01); *B65H 35/002* (2013.01); *A45D 2019/0091* (2013.01)

(58) Field of Classification Search
CPC ..... A45D 19/0025; A45D 2019/0091; B26D 5/38; B65H 35/002
USPC ..... 493/22
See application file for complete search history.

(56) References Cited

U.S. PATENT DOCUMENTS 3,533,616 A * 10/1970 Bettenhausen .... B65H 35/0026 493/338
4,488,466 A * 12/1984 Jones ..... B26D 1/085 225/105
5,000,725 A * 3/1991 Bauknecht ..... B26D 5/00 226/32
5,072,637 A * 12/1991 Reichental ..... B26D 7/0625 226/172
5,800,325 A * 9/1998 Wilkes ..... B31B 70/00 493/196
5,989,173 A * 11/1999 Lugea ..... B26D 5/10 493/356
6,189,428 B1 * 2/2001 Hoshino ..... B26D 7/22 83/147
6,234,943 B1 * 5/2001 Copin ..... B26D 5/32 493/11
6,416,453 B1 * 7/2002 Simonetti ..... B31B 50/00 493/189
6,732,626 B2 * 5/2004 Hong ..... B26D 7/088 221/30
6,926,225 B1 * 8/2005 Powers ..... B65B 67/085 225/47
8,142,341 B1 * 3/2012 Salvesen ..... A45D 19/00 493/356
8,382,649 B2 2/2013 Salvesen

* cited by examiner

*Primary Examiner* — Sameh Tawfik
(74) *Attorney, Agent, or Firm* — Arthur Jacob

(57) ABSTRACT

Apparatus and method deliver consecutive foil leaves of a selected length from a supply of foil of indeterminate length. An actuator system maintains a cutter at an elevation above a shearing blade, and then releases the cutter, in response to a sensor sensing that a selected length of foil has been delivered, so that the cutter, biased by gravity, drops to shear a foil leaf of selected length from the indeterminate length of foil. Subsequently, the actuator system returns the cutter to the elevation above the shearing blade where the cutter is maintained in readiness for a next-consecutive shearing operation.

13 Claims, 7 Drawing Sheets

DELIVERING FOIL LEAVES OF SELECTED LENGTHS FROM AN INDETERMINATE LENGTH OF FOIL

BACKGROUND OF THE INVENTION

Field of the Invention

The present invention relates generally to the provision of foil leaves utilized in the conduct of certain hair treatment and styling procedures in hair salons and pertains, more specifically, to facilitating the delivery of such foil leaves to a hair stylist in a hair salon with increased convenience, ease and economy.

Over the ages, women have sought to enhance their appearance through treatments directed toward rendering their hair more attractive. Among the more popular procedures carried out in hair salons are a number of techniques which have been developed for accomplishing changes in the color of selected sections of hair, utilizing various operations, and utensils designed to facilitate such operations.

Description of Related Art

One of the more ubiquitous techniques currently employed in hair salons for changing hair color in selected sections of hair utilizes multiple leaves of foil, usually a metal foil such as aluminum foil, to isolate selected sections of hair for treatment. Each section of hair is laid upon a corresponding leaf of foil, is treated by applying an appropriate treatment solution to the isolated section of hair, and then is wrapped within the foil leaf as further sections subsequently are isolated, treated and wrapped, until all selected sections have been treated. In the preferred configuration, each foil leaf is provided with a tab folded along one edge of the leaf for facilitating handling and support of the foil leaf during the course of the hair styling process. Upon the expiration of the time needed for the desired reaction to take place between each section of hair and the applied solution, the foil leaves are removed and are discarded, leaving behind the treated sections, ready for subsequent washing and styling to complete the beautification process.

BRIEF SUMMARY OF THE INVENTION

Usually, the foil leaves are made available to the hair stylist in boxes of individual leaves, configured for immediate use, with all of the leaves in a given box being of the same dimensions, thus requiring not only an inventory of multiple boxes of foil leaves of different dimensions, and a concomitant large stock of boxes, but also requiring that a smaller supply of different sizes be made available immediately at hand during each styling operation, leading to inconvenience, inefficiency and waste.

In two earlier patents, U.S. Pat. Nos. 8,142,341 and 8,382,649, there is described apparatus and method that facilitates the delivery of foil leaves of selected length from a supply of foil of indeterminate length. While the apparatus and method described in these patents provide a considerable improvement over the use of boxes of individual foil leaves of different dimensions, the described apparatus and method require a two-hand operation; that is, an operator must use one hand to advance foil from the supply to a delivery station and then, while holding the delivered foil in one hand, use the other hand to operate a cutter to sever a foil leaf of selected length from the foil drawn from the supply of foil of indeterminate length. Since the operator ordinarily will employ one hand to grasp and hold on to the isolated section of hair to be wrapped, while drawing a selected length of foil from the supply, the requirement for a second hand to operate a cutter presents a significant inconvenience.

The present invention alleviates that inconvenience and delivers to the hair stylist foil leaves of selected size, configured for immediate use, as needed, with still greater convenience and versatility, as well as increased economy. As such, the present invention attains several objects and advantages, some of which are summarized as follows: Delivers consecutive foil leaves directly to a hair stylist, as needed, in lengths selected manually by the stylist and severed from an indeterminate length of foil in a one-hand operation during the conduct of a styling operation; severs individual foil leaves consecutively from a supply of foil of indeterminate length, in a one-hand manual operation, as needed during a styling operation, for greater versatility, added convenience and increased economy; eliminates the requirement for maintaining an inventory of individual foil leaves of different dimensions, in favor of a single supply of foil of indeterminate length, thereby dramatically reducing cost; severs each foil leaf from a supply of foil of indeterminate length, as required, in any selected length, and configures each severed leaf, in a one-hand manual operation, for immediate use upon delivery to a stylist; simplifies a hair styling procedure of the kind requiring the use of foil leaves by delivery directly to a hair stylist, in a one-hand manual operation, foil leaves of selected length and desired configuration, ready for immediate use upon delivery; provides apparatus which is relatively simple in construction and use, and is relatively compact for ready and convenient placement and operation by a hair stylist during the course of a styling operation requiring multiple foil leaves of selected lengths; facilitates the conduct of a hair styling operation through utilization of a simple, effective and reliable single-handed procedure for delivery to a hair stylist foil leaves of selected lengths, configured for immediate use; provides a rugged apparatus of relatively simple construction capable of economical manufacture and reliable operation to deliver foil leaves, as needed, over an extended service life.

The above objects and advantages, as well as further objects and advantages, are attained by the present invention which may be described briefly as apparatus for delivering consecutive foil leaves, each leaf being of a selected leaf length severed from a supply of foil of indeterminate length, the apparatus comprising: a frame; a supply station on the frame for holding a supply of foil of indeterminate length; a delivery station spaced from the supply station along a feed path extending in a forward direction from the supply station to the delivery station; a shearing blade mounted on the frame and having a shearing edge extending across the feed path; a cutter having a cutting edge extending across the feed path, the cutter being mounted on the frame for movement of the cutting edge from a first position to a second position along a cutting path extending transverse to the feed path, the cutting path passing through the feed path and intercepting the feed path in shearing juxtaposition with the shearing edge of the shearing blade such that the foil will be sheared along the shearing edge as the cutting edge is moved from the first position, along the cutting path and through the feed path, to the second position to sever a leaf of selected leaf length from the indeterminate length of foil and thereby deliver the leaf of selected leaf length at the delivery station; a biasing arrangement establishing a biasing force for moving the cutter from the first position to the second position; and an actuating system for maintaining the cutter at the first position and for selectively releasing the cutter for movement in response to the biasing force to the second position, the actuating system including a sensor located in juxtaposition with the delivery station for sensing the presence of the foil upon a length of foil at the delivery station reaching the selected leaf length, and an actuator coupled to the cutter for releasing the cutter for movement of the cutter by the biasing force from the first position to the second position in response to placement of the foil in sensing juxtaposition with the sensor and for subsequently returning the cutter from the second position to the first position.

In addition, the present invention provides a method for delivering consecutive foil leaves, each leaf being of a selected leaf length severed from a supply of foil of indeterminate length, the method comprising: holding a supply of foil of indeterminate length at a supply station; locating a delivery station spaced from the supply station along a feed path extending in a forward direction from the supply station to the delivery station; extending a shearing edge of a shearing blade across the feed path; extending a cutting edge of a cutter across the feed path, with the cutter being arranged for movement of the cutting edge from a first position to a second position along a cutting path extending transverse to the feed path, the cutting path passing through the feed path and intercepting the feed path in shearing juxtaposition with the shearing edge of the shearing blade such that the foil will be sheared along the shearing edge as the cutting edge is moved from the first position, along the cutting path and through the feed path, to the second position to sever a leaf of selected leaf length from the indeterminate length of foil and thereby deliver the leaf of selected leaf length at the delivery station; establishing a biasing force for moving the cutter from the first position to the second position; maintaining the cutter at the first position and selectively releasing the cutter for movement in response to the biasing force to the second position; locating a sensor in juxtaposition with the delivery station; sensing the presence of the foil upon a length of foil at the delivery station reaching the selected leaf length; releasing the cutter for movement of the cutter by the biasing force from the first position to the second position in response to placement of the foil in sensing juxtaposition with the sensor; and subsequently returning the cutter from the second position to the first position.

The invention will be understood more fully, while still further objects and advantages will become apparent, in the following detailed description of preferred embodiments of the invention illustrated in the accompanying drawing, in which:

DETAILED DESCRIPTION OF THE INVENTION

Figure 1:
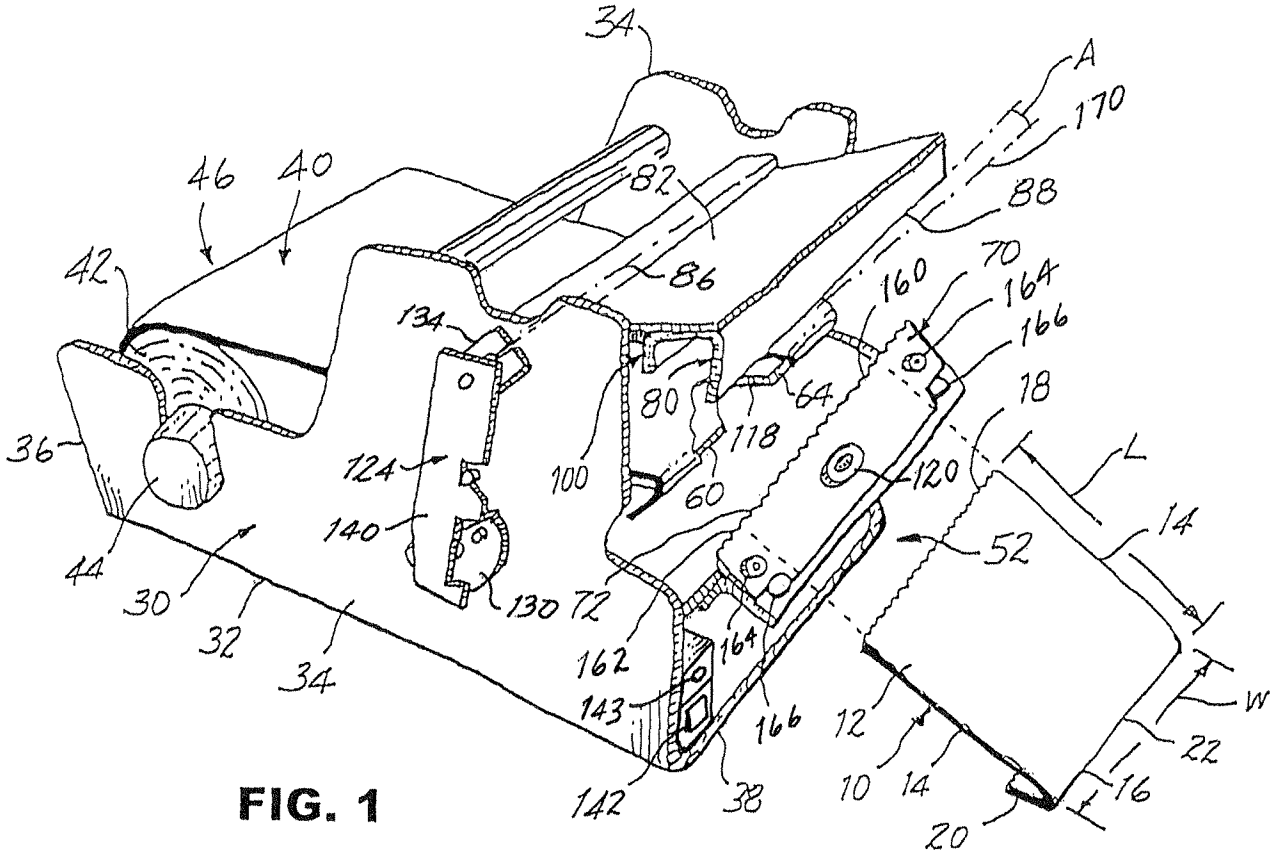
FIG. 1 is a pictorial view depicting an apparatus constructed in accordance with the present invention, operated in accordance with a method of the present invention.
Figure 2:
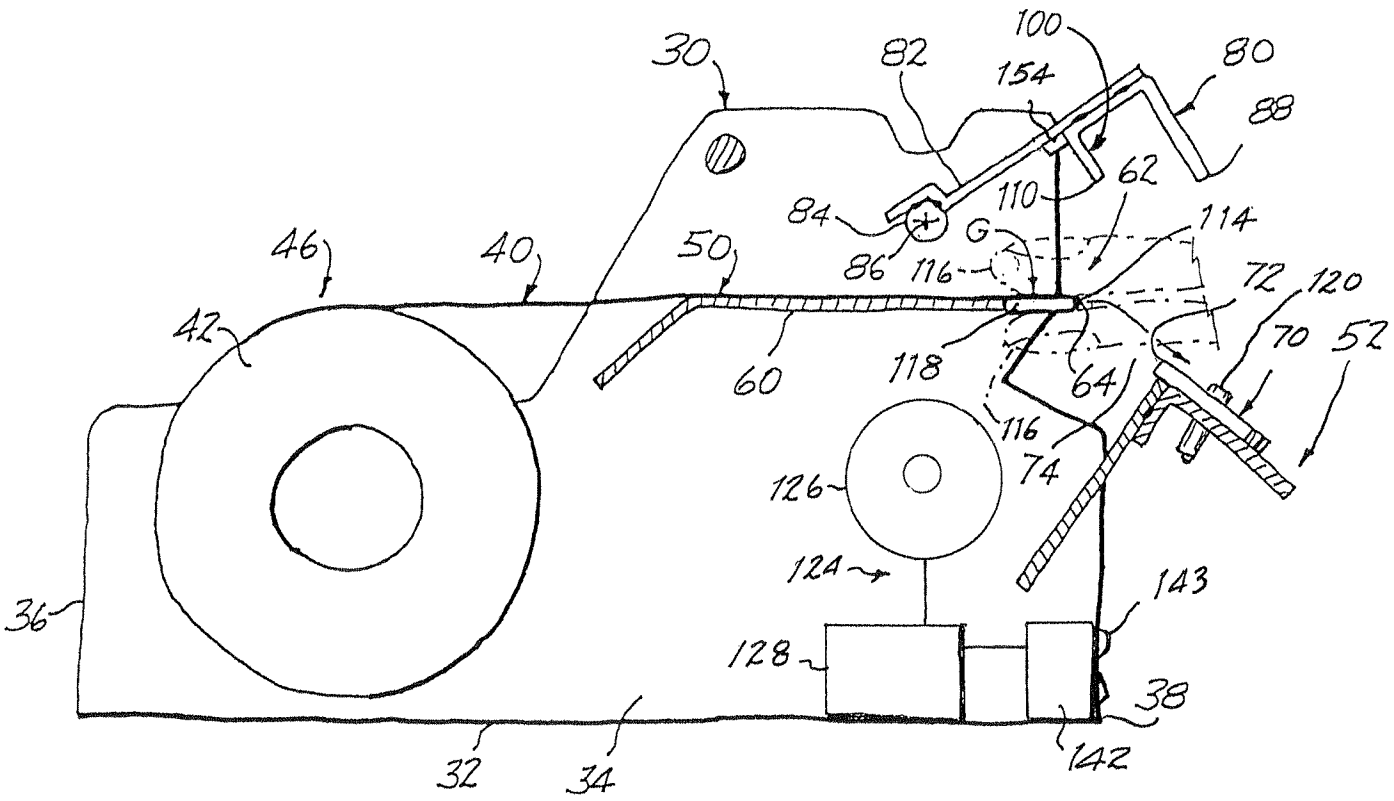
FIG. 2 is a largely diagrammatic longitudinal cross-sectional view of the apparatus showing internal details of construction.

Referring now to the drawing, and especially to FIGS. 1 and 2 thereof, a foil leaf to be used in connection with a hair styling procedure, as set forth above, is shown at 10 and is seen to include a body 12 having a predetermined lateral width W extending between opposite sides 14, and a longitudinal length L extending between a leading edge 16 and a trailing edge 18. A tab 20 is unitary with body 12 and is folded about a fold line 22 extending laterally across foil leaf 10 between the opposite sides 14 so as to be juxtaposed with body 12 adjacent the leading edge 16, thereby establishing a configuration facilitating use of foil leaf 10 in the described hair styling operation.

An apparatus constructed in accordance with the present invention is shown at 30 and includes a frame 32 having laterally opposite side walls 34 extending longitudinally between a rearward end 36 and a forward end 38 of frame 32. A supply of foil 40 is furnished in the form of a roll 42 of foil 40, providing a very extensive supply of foil 40 of indeterminate length. Roll 42 is placed upon an arbor 44, supported in frame 32 so as to be journaled for rotation within the frame 32 at a supply station 46 located adjacent the rearward end 36' of the frame 32 for feeding foil 40 as foil 40 is advanced along a feed path 50 to a delivery station 52 located adjacent the forward end 38 of frame 32.

A platform 60 is juxtaposed with the feed path 50 between the supply station 46 and a folding station 62 located longitudinally between the supply station 46 and the delivery station 52. The platform 60 is integral with frame 32, extends laterally between opposite side walls 34 of frame 32, and passes altitudinally beneath the feed path 50 such that foil 40 is drawn over platform 60 as the foil 40 is advanced along feed path 50 from supply station 46 to delivery station 52. Platform 60 includes a forward edge 64 facing forward and extending laterally across the feed path 50. A shearing blade 70 is mounted on frame 32 adjacent the delivery station 52 and includes a shearing edge 72 extending laterally across feed path 50, beneath the feed path 50, and spaced forward of the forward edge 64 of platform 60 by a gap 74 between the forward edge 64 and the shearing edge 72.

Figure 3:
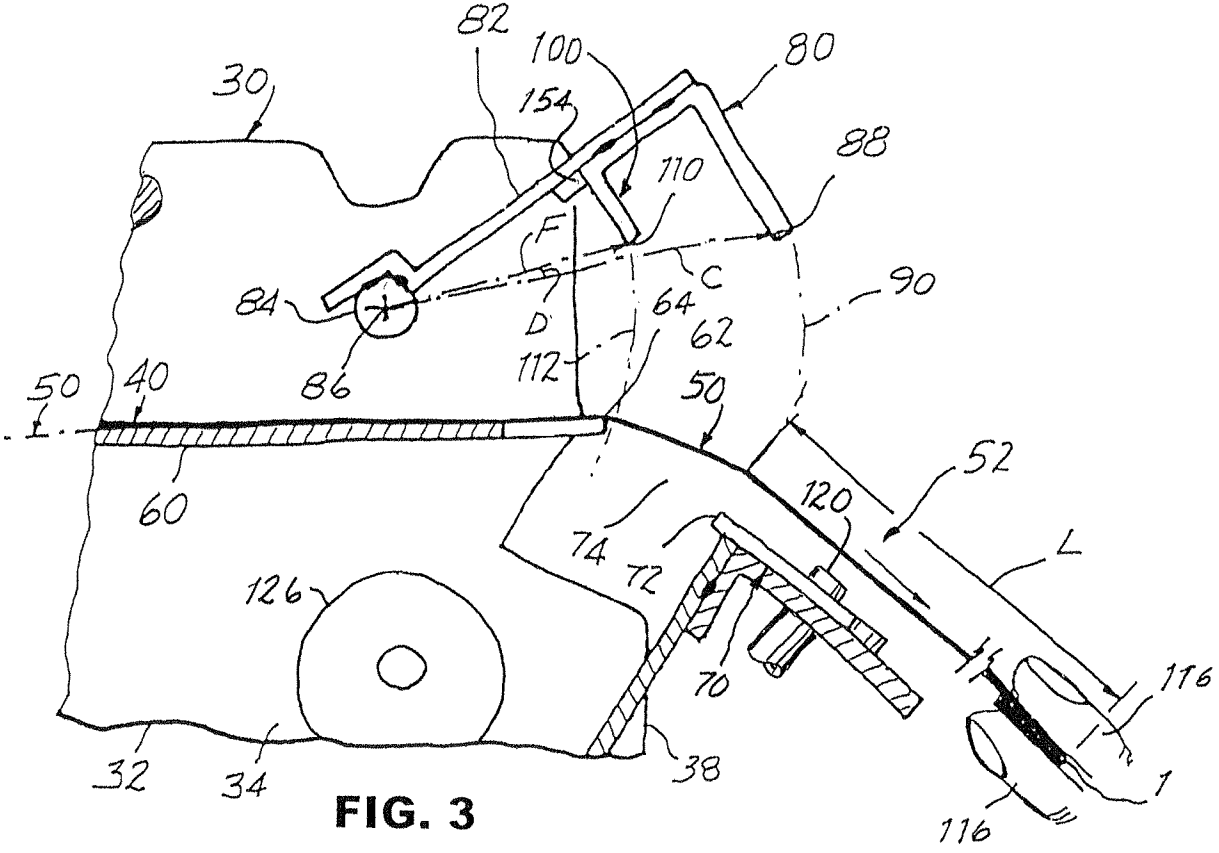
FIG. 3 is an enlarged fragmentary view of a portion of FIG. 2.
Figure 4:
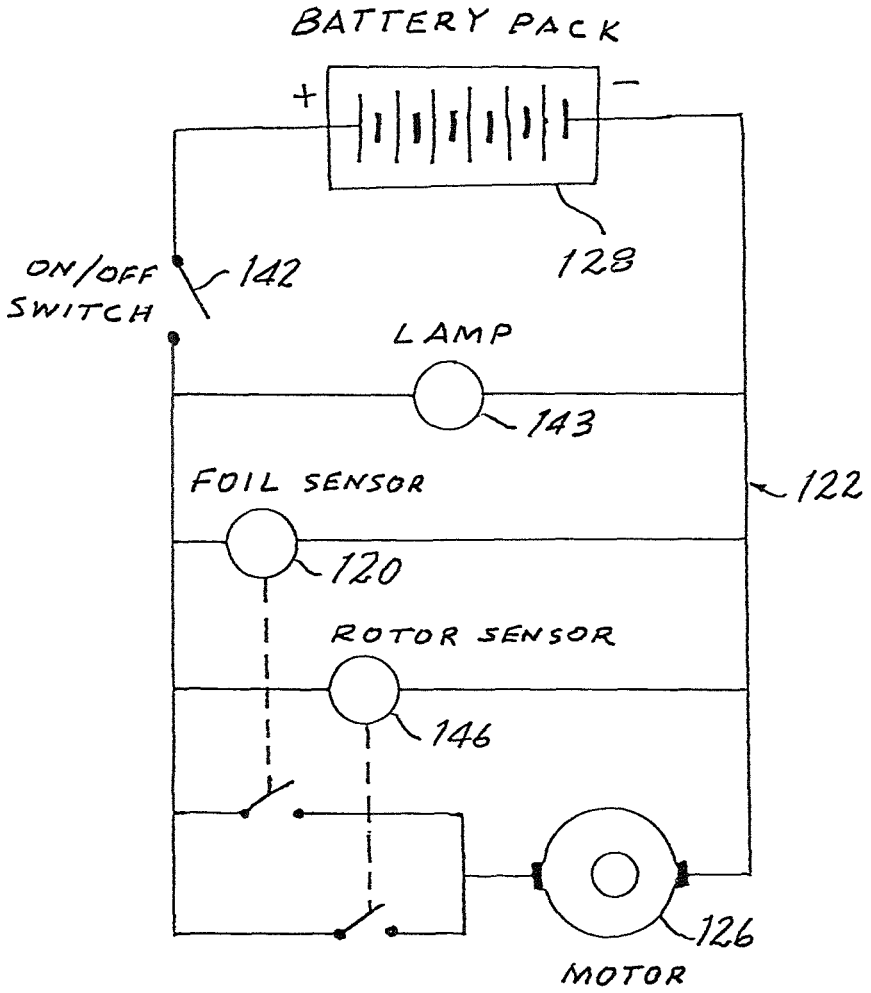
FIG. 4 is a circuit diagram showing a control circuit of the apparatus.
Figure 6:
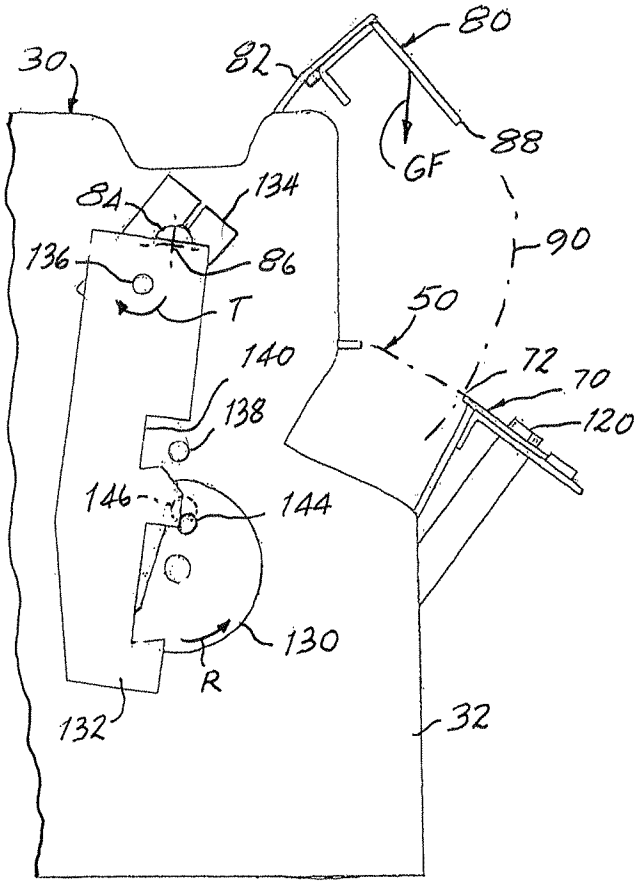
FIG. 6 is a largely diagrammatic, fragmentary side elevational view of the apparatus, similar to FIG. 5 and depicting another stage of operation of the apparatus.

A cutter 80 is carried by an arm 82 affixed to a shaft 84 extending laterally across frame 32 and journaled within side walls 34 for pivotal movement about a lateral pivotal axis 86 located altitudinally above feed path 50. Cutter 80 is placed at a first position, as seen in FIGS. 1 through 3, located at an elevation spaced above feed path 50 and depends downwardly from arm 82. Cutter 80 includes a cutting edge 88 extending laterally across feed path 50 such that cutting edge 88 is movable along a curved path shown in the form of arcuate cutting path 90 (see FIG. 3) extending transverse to feed path 50, the cutting path 90 passing through the feed path 50, at the gap 74, and intercepting feed path 50 in shearing juxtaposition with shearing edge 72. A folder 100 is carried by arm 82 and includes a folding member 110 depending from arm 82 and extending laterally across feed path 50, the folding member 110 being movable along a curved path shown in the form of arcuate folding path 112 (see FIG. 3) extending transverse to feed path 50, the folding path 112 passing through the feed path 50, at the gap 74, and intercepting the feed path 50 in folding juxtaposition with the forward edge 64 of the platform 60.

Referring now to FIG. 3, as well as with reference to FIGS. 1 and 2, when it is desired to deliver a foil leaf 10 for use by a hair stylist during a hair styling procedure, the hair stylist will reach into gap 74 and grasp foil 40 at a leading edge 114, as illustrated at G in FIG. 2, wherein fingers of the hair stylist are depicted in phantom at 116 and are shown gripping the foil 40 at leading edge 130 to draw the foil forward along feed path 50, across gap 74, toward delivery station 52, as seen in FIG. 3. The grip at G is facilitated by the provision of a finger recess 118 at the forward edge 64 of platform 60, located intermediate the side walls 34 of frame 32, as illustrated in FIG. 1.

Foil 40 then is drawn manually from roll 42 and advanced along feed path 50 until the hair stylist determines visually that a selected length L has been delivered between leading edge 114 of foil 40 and shearing edge 72 of shearing blade 70, as depicted in FIG. 3. Then, the hair stylist will lower the foil 40 to bring foil 40 into sensing juxtaposition with a sensor 120 located below feed path 50; that is, foil 40 is brought either into contact with sensor 120 or in close enough proximity to sensor 120 to sense the presence of a selected length L of foil 40 at the delivery station 52. With reference now to FIGS. 4 through 8, sensor 120 is a component of an electrical circuit 122 of an actuator system 124 that includes an actuator in the form of an electric motor 126 powered by a battery pack 128 located within frame 32 of apparatus 30. A rotor 130 is carried by motor 126 for rotation in response to activation of motor 126, from a rest position, depicted in FIG. 5, through a complete cycle of operation, as will be described below.

Figure 5:
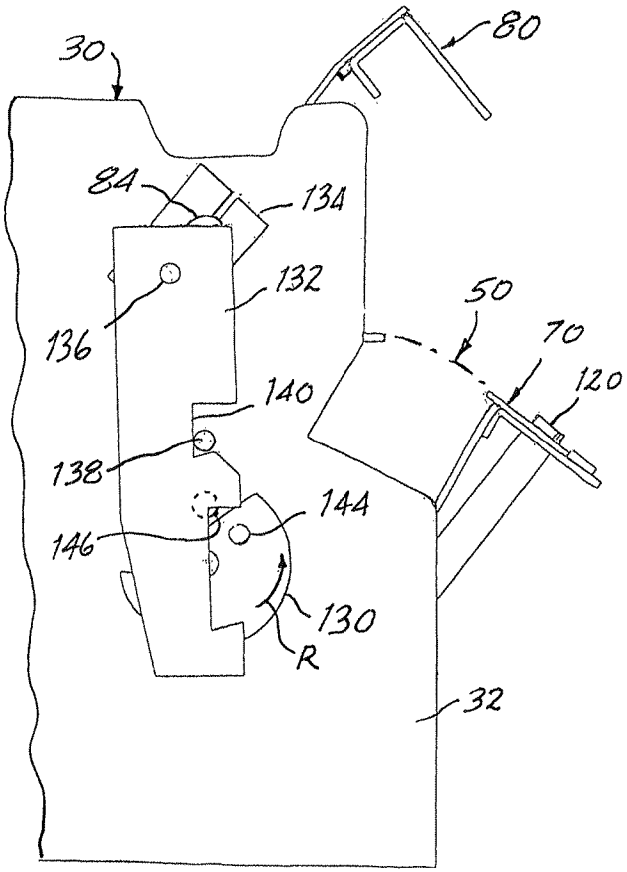
FIG. 5 is a largely diagrammatic, fragmentary side elevational view of the apparatus depicting a stage of operation of the apparatus in accordance with a method of the present invention.

As best seen in FIG. 5, cutter 80 is retained in the first position, elevated above feed path 50, by a link shown in the form of a bar 132 coupled to a crank 134 at a pivotal connection 136. Crank 134 is affixed to shaft 84 for rotation with shaft 84. A stop pin 138 is affixed to frame 32 and is engaged with bar 132 at a notch 140 in bar 132 such that cutter 80 remains stationary, retained at the first position of cutter 80, against dropping by gravity, as long as stop pin 138 is engaged with bar 132, as depicted in FIG. 5.

Figure 7:
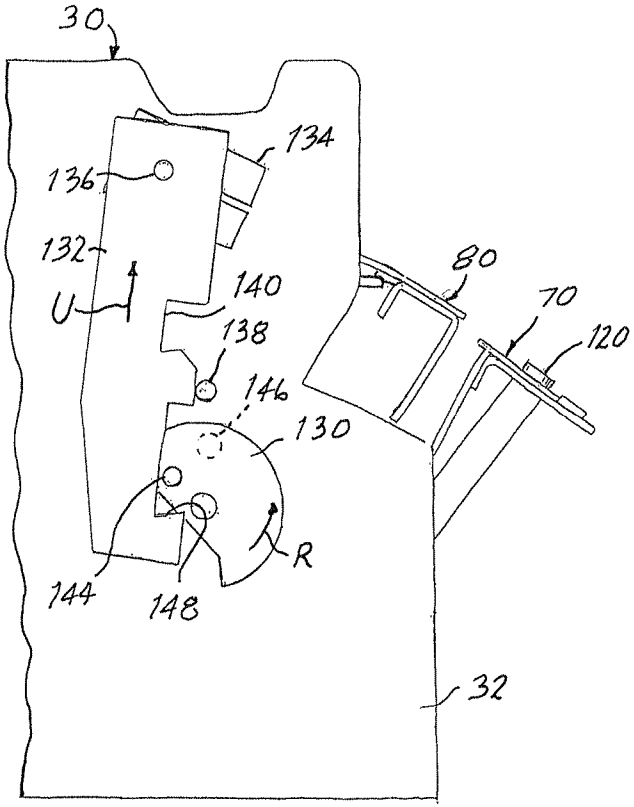
FIG. 7 is a largely diagrammatic, fragmentary side elevational view of the apparatus, similar to FIG. 5, and depicting still another stage of operation of the apparatus.

Upon closing an on/off electrical switch 142, indicated by an indicator lamp 143, and then moving foil 40 into sensing juxtaposition with sensor 120, sensor 120 is activated to complete an electrical circuit between battery pack 128 and motor 126, in turn activating motor 126 to rotate rotor 130 in the direction R. Upon rotor 130 reaching the position depicted in FIG. 6, a drive pin 144 carried by rotor 130 will engage bar 132 and rotate bar 132 about pivotal connection 136, in the direction T, thereby disengaging bar 132 from stop pin 138. Upon such disengagement of stop pin 138 from bar 132, bar 132 will become free to move upwardly, in the direction U, as depicted in FIG. 7, as a result of downward movement of cutter 80 which now is free to move along arcuate cutting path 90, in response to the biasing force of gravity, indicated at GF, thereby pivoting arm 82 about pivotal axis 86, and moving cutting edge 88 along cutting path 90 until cutting edge 88 intersects feed path 50 and engages foil 40 in shearing juxtaposition with shearing edge 72. As cutting edge 88 continues along cutting path 90, cutting edge 88 passes through feed path 50 and shears foil leaf 10 from the indeterminate length of foil 40, whereby a foil leaf 10 of selected length L is delivered to the hair stylist at delivery station 52, as shown in FIG. 1. Cutter 80 then comes to rest at the second position, depicted in FIG. 7.

Figure 8:
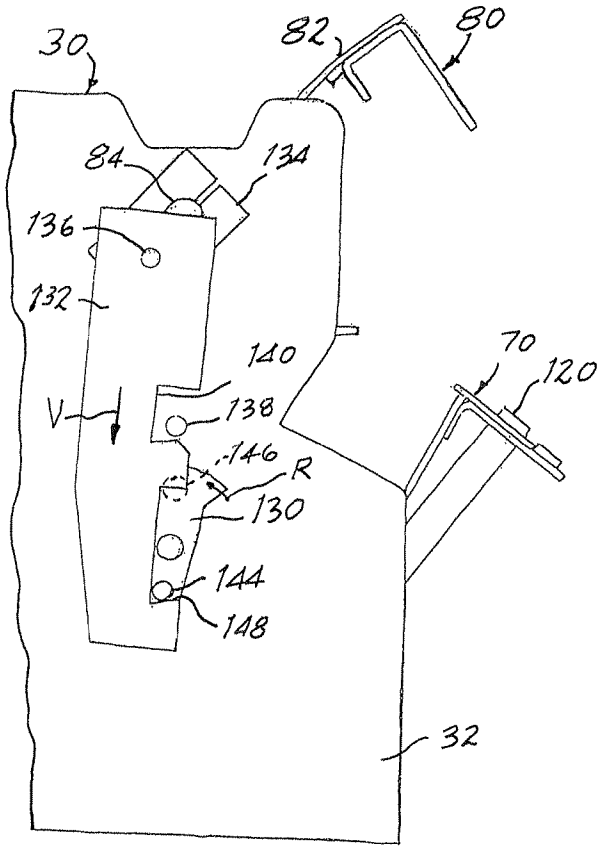
FIG. 8 is a largely diagrammatic, fragmentary side elevational view of the apparatus, similar to FIG. 5, and depicting yet another stage of operation of the apparatus.

Rotation of rotor 130 by motor 126 is continued by virtue of the activation of a further sensor 146, in response to bringing rotor 130 into sensing juxtaposition with further sensor 146; that is, in response to bringing rotor 130 either into close enough proximity to further sensor 146 or into actual contact with further sensor 146, which further sensor 146 is mounted upon frame 32, behind rotor 130, in position to sense the condition of rotor 130 as the rotor 130 is rotated through a full cycle of operation. Such continued rotation of rotor 130 brings drive pin 144 into engagement with a shoulder 148 of bar 132 and thereby drives bar 132 downwardly, in direction V, and rotates crank 134 to return cutter 80 back to the elevated first position, as depicted in FIG. 8. Once cutter 80 is restored to the elevated first position, rotation of rotor 130 is continued until rotor 130 is returned to the position depicted in FIG. 5, wherein sensing juxtaposition between rotor 130 and further sensor 146 is discontinued, deactivating further sensor 146 and, in turn, deactivating motor 126, awaiting a next withdrawal by the hair stylist of foil 40 from roll 42 and movement of the withdrawn length of foil 40 into close enough proximity or actual contact with sensor 120.

Figure 10:
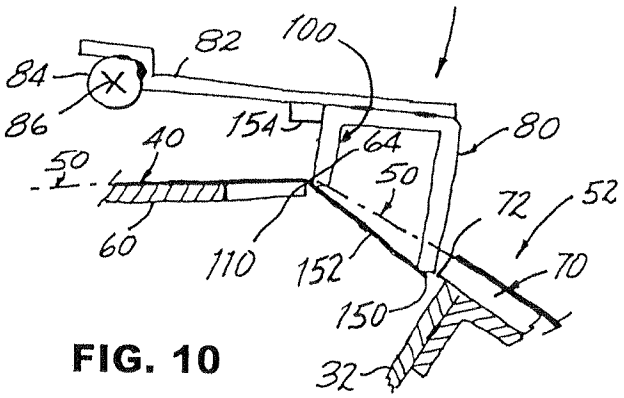
FIG. 10 is a largely diagrammatic, fragmentary view similar to FIG. 9, and showing another stage of operation of the apparatus.
Figure 9:
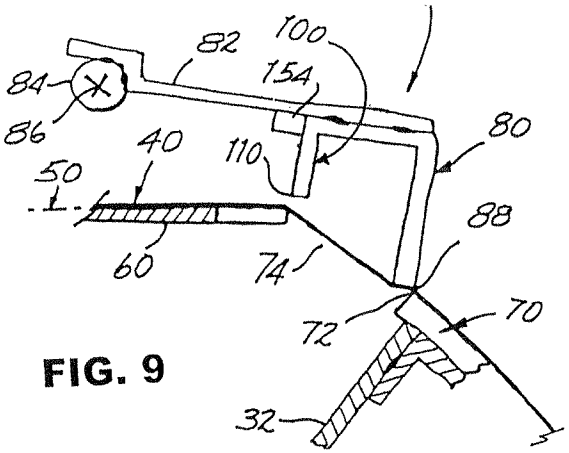
FIG. 9 is a largely diagrammatic, fragmentary view of a portion of FIG. 3 showing a stage of operation of the apparatus.
Figure 11:
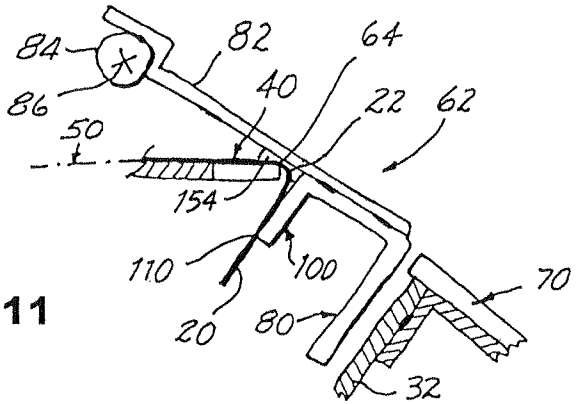
FIG. 11 is a largely diagrammatic, fragmentary view similar to FIG. 9, and showing still another stage of operation of the apparatus.

Turning now to FIGS. 9 through 11, the aforesaid pivotal movement of arm 82 downwardly, as cutter 80 moves from the first position toward the second position, brings cutter 80 to feed path 50 and engages cutter 80 with foil 40, as illustrated in FIG. 9. Simultaneously, pivotal movement of folding member 110 about the common pivotal axis 86, along folding path 112, moves folding member 110 toward feed path 50. Continued pivotal movement severs foil 40, leaving behind a severed edge 150 and engages foil 40 in folding juxtaposition with forward edge 64 of platform 60, as seen in FIG. 10. As folding member 110 continues along folding path 112, folding member 110 passes through feed path 50 to engage and fold a segment 152 of foil 40, which segment 152 extends between forward edge 64 of platform 60 and severed edge 150 of foil 40 and spans gap 74, to establish tab 20 folded along fold line 22, as illustrated in FIG. 11, ready to be grasped for delivering a next-consecutive foil leaf 10.

As shown diagrammatically in FIGS. 9 through 11, cutting edge 88 and folding member 110 are located relative to one-another such that foil 40 first is sheared at shearing edge 72 and then segment 152 of foil 40 is engaged immediately after shearing, to fold tab 2G along fold line 22. To that end, folding member 110 lags behind cutting edge 88 as arm 82 is pivoted downwardly about pivotal axis 86 to move the cutting edge 88 along cutting path 90 and the folding member 110 along folding path 112; that is, with reference to FIG. 3, cutting edge 88 lies on a cutting radius of curvature C of arcuate cutting path 90, while folding member 110 lies on a folding radius of curvature F of arcuate folding path 112, with radius F being less than radius C and spaced a relatively small angular distance D behind radius C, angular distance D being of sufficient magnitude to assure that folding member 110 is spaced away from foil 40 located along feed path 50 at folding station 62 when cutting edge 88 reaches the foil 40 in shearing juxtaposition with shearing edge 72, and does not reach folding juxtaposition with forward edge 64 of platform 60 until after foil leaf 10 is severed from indeterminate length of foil 40. In this manner, a single sweep of arm 82 from the first, elevated position illustrated in FIGS. 1 through 3, 5 and 6, to the second, lower position illustrated in FIGS. 7 and 11, severs a foil leaf 10 of selected length L from the indeterminate length of foil 40 and readies foil 40 for the delivery of a next-consecutive severed foil leaf 10. In the second, lower position, arm 82 comes to rest against a resilient stop pad 154 which is affixed to arm 82. Upon return of cutter 80 to the first, elevated position, as described above, apparatus 30 will be ready for the delivery of another foil leaf 10 of any selected length L, as determined by the hair stylist. It is noted that in addition to providing the desired tab 20 folded along fold line 22 of a severed foil leaf 10, the establishment of tab 20 at leading edge 16 provides a convenient and somewhat reinforced gripping site on, foil 40, facilitating the grasping and manual advancement of foil 40 along feed path 50, as described above, while resisting unwanted distortion of foil 40 and foil leaf 10.

Returning now to FIG. 1, in the preferred construction, shearing edge 72 includes an undulate configuration 160 providing sharp teeth 162 which effectively will penetrate foil 40 and facilitate the shearing of foil leaf 10 from foil 40 over an extended service life. However, should it become necessary to replace shearing blade 70, such replacement is accomplished readily merely by removing mounting screws 164 to release shearing blade 70 from frame 32. Upon placing a replacement shearing blade 70 in apparatus 30, the replacement shearing blade 70 is located accurately by engagement against blade stops 1166 affixed to frame 32 for precisely positioning the shearing blade 70 prior to securing the shearing blade 70 in place on frame 32. In order to facilitate shearing of each foil leaf 10 from the indeterminate length of foil 40, cutting edge 88 preferably extends along a slight angle A relative to the direction 170 of shearing edge 72 so that shearing is accomplished gradually as the cutting edge 88 passes through feed path 50 at the shearing edge 72.

By enabling a hair stylist to draw any length of foil 40 from roll 42, the hair stylist can select any desired length L for a foil leaf 10 as needed during the course of conducting a hair styling procedure, without having to select from only fixed sizes made available at a particular work station. Moreover, the ability to make available any desired length of foil leaf 10 close at hand, with a compact apparatus and without the necessity for maintaining an inventory of individual foil leaves of multiple fixed sizes, not only increases versatility and convenience in providing a precise desired size, but enables greater economy through the use of a roll 42 of foil 40 which is capable of supplying many more foil leaves 10 at a very much reduced cost over individually packaged foil leaves of fixed sizes. Further, the hair stylist is able to effect the delivery and severing of a selected length of foil 40 to attain a desired length L for a delivered foil leaf 10, without relinquishing a grip on the isolated section of hair to be wrapped.

It will be seen that the present invention attains all of the objects and advantages summarized above, namely: Delivers consecutive foil leaves directly to a hair stylist, as needed, in lengths selected manually by the stylist and severed from an indeterminate length of foil in a one-hand operation during the conduct of a styling operation; severs individual foil leaves consecutively from a supply of foil of indeterminate length, in a one-hand manual operation, as needed during a styling operation, for greater versatility, added convenience and increased economy; eliminates the requirement for maintaining an inventory of individual foil leaves of different dimensions, in favor of a single supply of foil of indeterminate length, thereby dramatically reducing cost; severs each foil leaf from a supply of foil of indeterminate length, as required, in any selected length, and configures each severed leaf, in a one-hand manual operation, for immediate use upon delivery to a stylist; simplifies a hair styling procedure of the kind requiring the use of foil leaves by delivery directly to a hair stylist, in a one-hand manual operation, foil leaves of selected length and desired configuration, ready for immediate use upon delivery; provides apparatus which is relatively simple in construction and use, and is relatively compact for ready and convenient placement and operation by a hair stylist during the course of a styling operation requiring multiple foil leaves of selected lengths; facilitates the conduct of a hair styling operation through utilization of a simple, effective and reliable single-handed procedure for delivery to a hair stylist foil leaves of selected lengths, configured for immediate use; provides a rugged apparatus of relatively simple construction capable of economical manufacture and reliable operation to deliver foil leaves, as needed, over an extended service life.

It is to be understood that the above description of preferred embodiments of the invention is provided by way of example only. Various details of design, construction and procedure may be modified without departing from the true spirit and scope of the invention, as set forth in the appended claims.

The embodiments of the invention in which an exclusive property or privilege is claimed are defined as follows:

1. Apparatus for delivering consecutive foil leaves, each leaf being of a manually selected leaf length severed from a supply of foil of indeterminate length, the apparatus comprising:

a frame;

a supply station on the frame for holding a supply of foil of indeterminate length;

a delivery station spaced from the supply station along a feed path extending in a forward direction from the supply station to the delivery station;

a shearing blade mounted on the frame and having a shearing edge extending across the feed path;

a cutter having a cutting edge extending across the feed path, the cutter being mounted on the frame to move the cutting edge from a first position to a second position along a cutting path extending transverse to the feed path, the cutting path passing through the feed path and intercepting the feed path in shearing juxtaposition with the shearing edge of the shearing blade, wherein the foil will be sheared along the shearing edge as the cutting edge is moved from the first position, along the cutting path and through the feed path, to the second position to sever a leaf of manually selected leaf length from the indeterminate length of foil and thereby deliver the leaf of manually selected leaf length at the delivery station;

a biasing arrangement coupled with the cutter to establish, upon placement of the cutter at the first position, a biasing force directed toward moving the cutter from the first position to the second position; the biasing arrangement comprising an actuating system including a link coupled with the cutter and movable between a first location to maintain the cutter at the first position, against movement of the cutter by the biasing force from the first position to the second position, and a second location wherein the cutter is released to move in response to the biasing force to the second position, the actuating system further including a sensor located in juxtaposition with the delivery station to sense juxtaposition of the foil with the sensor upon a length of foil at the delivery station reaching the manually selected leaf length, and an actuator to release the link for movement of the link from the first location to the second location, thereby enabling movement of the cutter by the biasing force from the first position to the second position in response to manual placement of the foil in sensing juxtaposition with the sensor, and to subsequently return the link to the first location, to return the cutter from the second position to the first position.

2. The apparatus of claim 1 wherein the first position is located at a first elevation, and the second position is located at a second elevation below the first elevation upon release of the cutter to move from the first position to the second position, the biasing force comprises a gravitational force.

3. The apparatus of claim 2 wherein the actuating system includes a further sensor juxtaposed with the actuator to sense the condition of the actuator to continue activation of the actuator through a full cycle of operation comprised of movement of the cutter from the second position to the first position, retention of the cutter at the first position, and release of the cutter in response to the sensor to move of the cutter by the biasing force from the first position to the second position.

4. The apparatus of claim 2 wherein the cutter is mounted upon the frame for pivotal movement between the first position and the second position.

5. The apparatus of claim 4 wherein the actuator comprises an electric motor and the link couples the electric motor with the cutter to move of the cutter by the electric motor through a full cycle of operation comprised of movement of the cutter from the second position to the first position, retention of the cutter at the first position, and release of the cutter in response to the sensor to move of the cutter by the biasing force from the first position to the second position.

6. The apparatus of claim 5 wherein the actuating system includes a further sensor juxtaposed with the link to sense the condition of the link to continue activation of the electric motor through the full cycle of operation.

7. The apparatus of claim 1 wherein each leaf includes a unitary tab folded along a fold line extending across the leaf, adjacent a leading edge of the leaf, the apparatus further comprising:

a folding station located between the supply station and the delivery station;

a platform in juxtaposed with the feed path and having a forward edge located at the folding station;

the shearing edge of the shearing blade being spaced forward of the forward edge of the platform by a gap between the forward edge of the platform and the shearing edge of the shearing blade;

the cutting path passes through the feed path at the gap such that the foil will be sheared along the shearing edge as the cutting edge is moved through the gap; and a folder having a folding member extending across the feed path, the folder being mounted on the frame to move the folding member along a folding path extending transverse to the feed path, the folding path passing through the feed path, at the gap, and intercepting the feed path in folding juxtaposition with the forward edge of the platform;

the folding member being located relative to the cutting edge to intercept the feed path subsequent to interception of the cutting edge with the feed path as the cutting edge and the folding member are moved through the feed path and into the gap, to engage the folding member with a segment of the foil extending between the forward edge of the platform and the severed edge of the foil and fold the segment about the forward edge, along a fold line defined by the forward edge of the platform, to establish simultaneously a tab between the fold line and the severed edge of the indeterminate length of foil and, at the fold line, the leading edge of a next-consecutive foil leaf.

8. The apparatus of claim 7 wherein:

the cutting path comprises a first curved path having a first radius of curvature;

the folding path comprises a second curved path having a second radius of curvature; and the folding member is located relative to the cutting edge, wherein upon the cutting edge reaching shearing juxtaposition with the shearing edge, the folding member is spaced from folding juxtaposition with the forward edge of the platform by an angular distance between the first radius of curvature and the second radius of curvature, wherein the folding member will reach the feed path subsequent to the cutting edge reaching the feed path.

9. The apparatus of claim 8 wherein the angular distance is of a magnitude which spaces the folding member away from the foil at the forward edge of the platform when the cutting edge reaches the foil at the shearing edge of the shearing blade.

10. The apparatus of claim 9 wherein the first curved path is arcuate, the second curved path is arcuate, and the first radius of curvature is greater than the second radius of curvature.

11. The apparatus of claim 10 wherein the cutter and the folder are mounted upon the frame for pivotal movement about a common pivotal axis.

12. The apparatus of claim 1 wherein the supply of foil comprises a roll of foil journaled to rotate the frame at the supply station in response to advancement of the foil along the feed path.

13. The apparatus of claim 12 wherein the roll of foil is rotatable in response to manual advancement of the foil along the feed path.

* * * * *